US006543402B2

(12) United States Patent
Burns

(10) Patent No.: US 6,543,402 B2
(45) Date of Patent: Apr. 8, 2003

(54) LOAD BIASING RETAINER CLIP AND VALVE ACTUATOR SUBASSEMBLY

(75) Inventor: John J. Burns, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/834,005

(22) Filed: Apr. 12, 2001

(65) Prior Publication Data

US 2001/0035144 A1 Nov. 1, 2001

Related U.S. Application Data

(60) Provisional application No. 60/196,434, filed on Apr. 12, 2000.

(51) Int. Cl.[7] ..... F01L 1/18

(52) U.S. Cl. ..... 123/90.41; 123/90.39; 123/90.42; 123/90.43; 123/90.45; 123/90.46

(58) Field of Search ..... 123/90.39, 90.41, 123/90.43, 90.45, 90.46, 90.42; 74/519, 559

(56) References Cited

U.S. PATENT DOCUMENTS 4,488,520 A * 12/1984 Almor ..... 123/90.39
4,598,674 A * 7/1986 Nono ..... 123/90.41
4,676,203 A * 6/1987 Nouno ..... 123/90.42
5,775,280 A * 7/1998 Schmidt ..... 123/90.41
6,138,626 A * 10/2000 Speil ..... 123/90.39

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A retainer clip includes a U-shaped body, first and second legs, and a resilient segment interconnecting first ends of the legs. The legs are adapted to resiliently engage opposite sides of a wall of a rockable actuator member. A second end of the first leg includes a guide recess having a clip edge. A second end of the second leg includes a gripping recess and opposing resilient edges adapted to frictionally grip opposite sides of a cylindrical member engaged with a socket in a second side of the wall. The resilient edges frictionally grip the cylindrical member at points on an axis intersecting and normal to the axial center line of the cylindrical member. The retainer clip is adapted to frictionally retain the cylindrical member in the socket to thereby form a subassembly for installation in a valve train.

22 Claims, 4 Drawing Sheets

LOAD BIASING RETAINER CLIP AND VALVE ACTUATOR SUBASSEMBLY

CROSS-REFERENCE OF RELATED APPLICATIONS

This application claims the benefit of U.S. Provisional Application Serial No. 60/196,434, filed Apr. 12, 2000.

TECHNICAL FIELD

The present invention relates generally to valve actuator subassemblies, such as those for use in the valve gear of internal combustion engines. More particularly, the present invention relates to retainer clips for holding together elements of a subassembly, such as a finger follower and a hydraulic lash adjuster plunger or pivot. Most particularly, the present invention relates to clips that provide bias loading of the finger followers against associated valve stems during engine assembly.

BACKGROUND OF THE INVENTION

When assembling internal combustion piston engines of the overhead camshaft type subassemblies including a pivot or hydraulic lash adjuster (HLA) having a cylindrical plunger and a finger follower that is rockable or pivotable about the pivot in engine operation may be provided. The subassembly may include a retainer clip for holding the finger follower in assembly with the lash adjuster or pivot in order to simplify installation of the subassembly into an engine. In such subassemblies, it has been common to provide a groove around the lash adjuster plunger to receive edges of an opening in the retainer clip applied to maintain the finger follower and lash adjuster in assembly. Other subassemblies may include a retainer clip as described in U.S. Pat. No. 6,047,675, which is incorporated herein by reference. Such a clip eliminates the need for the aforementioned groove around the lash adjuster plunger and serves to hold the HLA at a fixed angle to the finger follower to thereby facilitate installation of the subassembly to an engine. However, the clip does not bias the opposite end of the follower against the associated valve stem, and therefore does not encourage the maintenance of proper alignment and contact of the follower to the stem before the camshaft is installed in contact with the follower.

Therefore, what is needed in the art is a retainer clip that simplifies installation of the subassembly in an engine.

Furthermore, what is needed in the art is a retainer clip that maintains the HLA at an angle to the finger follower to thereby ease installation of the assembly to an engine.

Moreover, what is needed in the art is a retainer clip that keeps the finger follower in proper alignment and position with the valve stem until the camshaft is secured to the engine.

SUMMARY OF THE INVENTION

The present invention provides an improved retainer clip concept for use in valve actuator subassemblies. The retainer clip has generally a U-shaped body with legs that clip over the end of a wall in the body of a finger follower. A first leg includes a gripping recess that engages diametrically opposite sides of a cylindrical member, such as the plunger of a HLA, as in the prior art. A second leg of the clip includes a guide recess that engages a portion on a first side of the wall at a point offset from the axial centerline of the HLA and closer to the point at which the finger follower contacts the valve stem.

The gripping recess includes opposed resilient edges that frictionally engage the cylindrical surface of, for example, the HLA plunger and hold it in assembly with the finger follower. Preferably, the resilient edges engage the cylindrical surface of the plunger at points nearly aligned on an axis intersecting with and normal to the axial center line of the cylindrical member. The frictional engagement of the resilient edges on the cylindrical surface is adequate to not only retain the parts together, but also to position the HLA at an angle to the finger follower that allows easy installation of the subassembly in an engine.

The guide recess includes a clip edge adapted to engage a first side of the wall whereby substantially only the clip edge of the guide recess contacts the first side of the wall at a point inward from the axial center line of the cylindrical member thereby imposing a downward force on an associated valve stem after the subassembly is installed in said valve train. The moment produced about the pivot point on the HLA keeps the follower in proper alignment and position with said valve stem until the camshaft is secured to the engine.

In a preferred embodiment, the retainer clip is formed as a unitary member from a single piece of spring material. However, an alternative sheet metal embodiment is also disclosed.

BRIEF DESCRIPTION OF THE DRAWINGS

These and other features and advantages of the invention will be more fully understood from the following description of certain specific embodiments of the invention taken together with accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
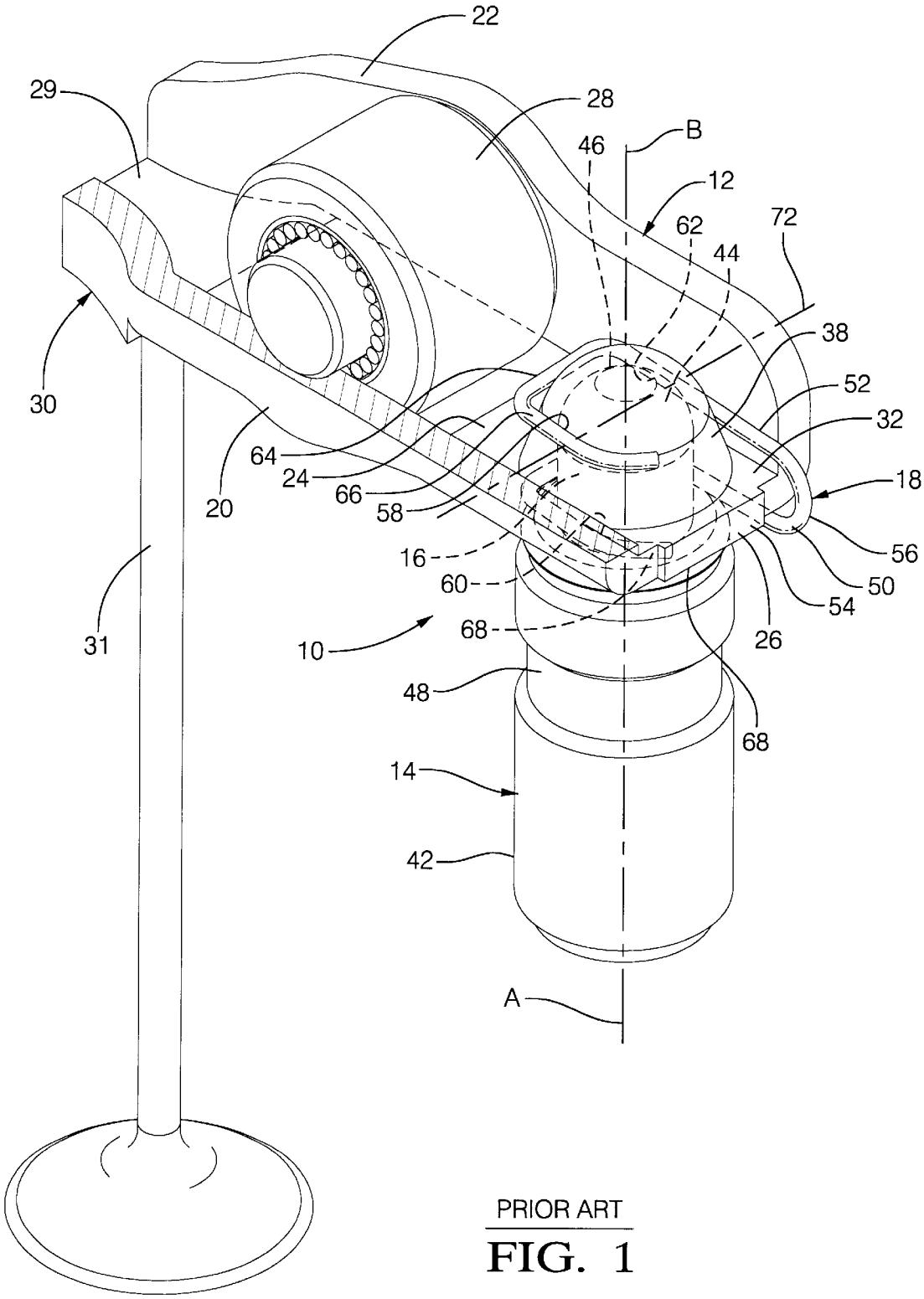
PRIOR ART FIG. 1
FIG. 1 is a pictorial view of the prior art subassembly showing the assembly force of the clip exerted along or near the axial center of the HLA.
Figure 2:
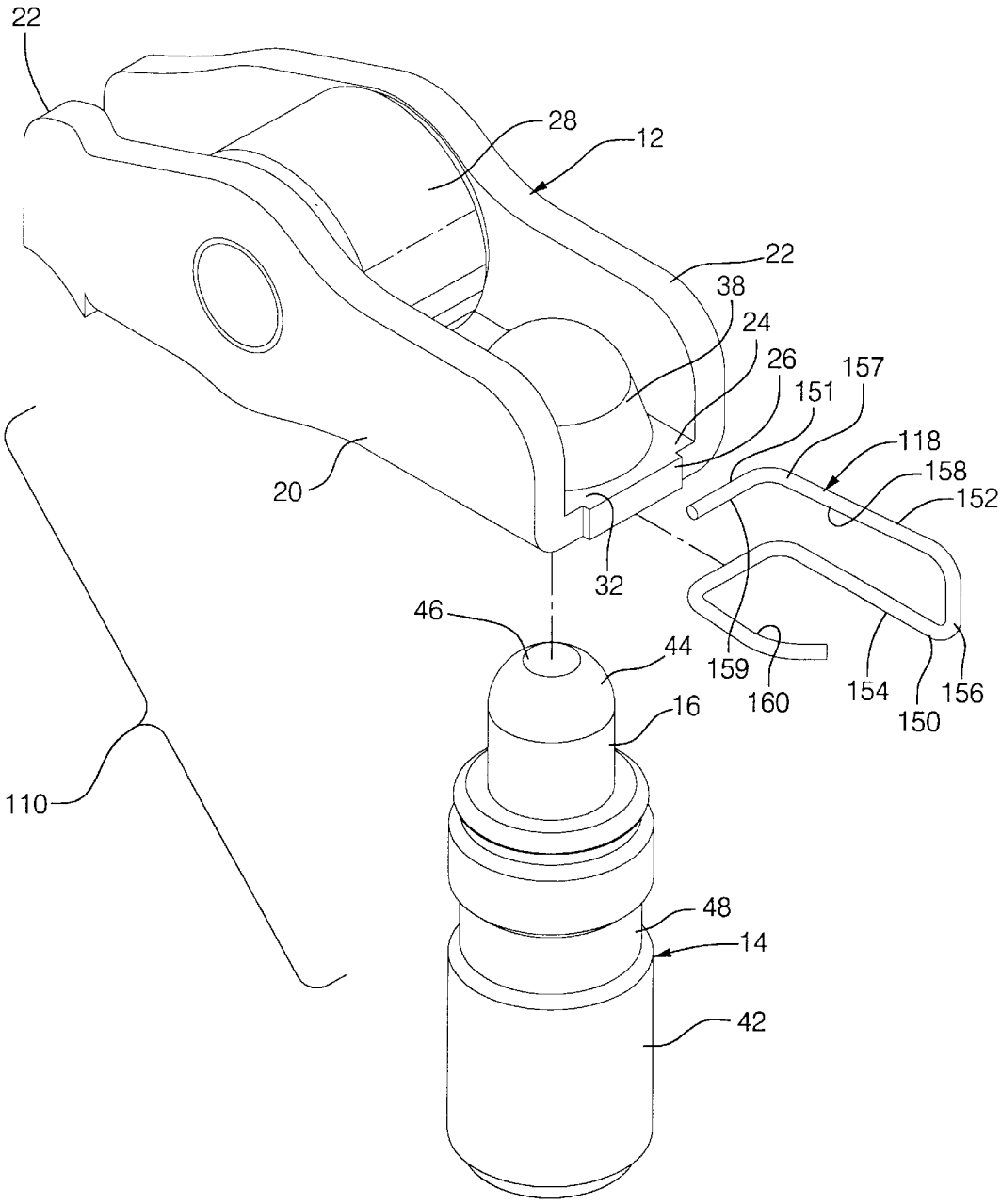
FIG. 2 is an exploded pictorial view of a valve actuator subassembly of a finger follower and a hydraulic lash adjuster connected by one embodiment of a retainer clip of the present invention.

Referring first to FIG. 1 of the drawings, numeral 10 generally depicts a valve actuator subassembly of the prior art including a rockable actuator member in the form of a finger follower 12, a hydraulic lash adjuster 14 having a cylindrical plunger 16, and a retainer clip 18. The clip 18 is provided to hold the HLA 14 and follower 12 together in the subassembly 10 for ease of handling and subsequent assembly into the valve actuating mechanism of an automotive piston engine, not shown.

The finger follower 12 is of a type used in overhead camshaft engines and includes a formed metal arm 20 having side walls 22 connected at opposite ends along their lower edges by a bottom wall 24 having an outer end 26. For clarity, the follower in FIG. 1 is shown with one side wall cut away. A cam follower roller 28 is carried between the side walls 22 and is engagable in use with a cam of an associated engine camshaft (not shown) positioned in a fixed relation above the follower roller. At an inner end 29 of the follower, the bottom wall forms a seat or pallet 30 for engaging an associated valve stem 31. The outer and inner portions of the bottom wall are separated to provide space for the roller and minimize the weight of the follower.

Figure 3:
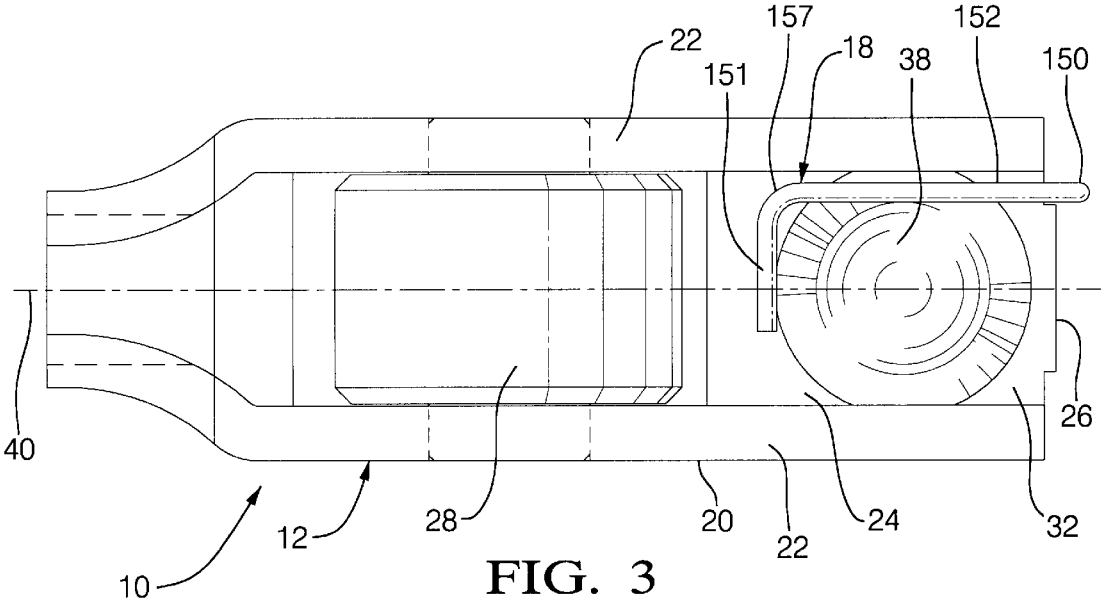
FIG. 3 is a top view of the subassembly of FIG. 2.
Figure 4:
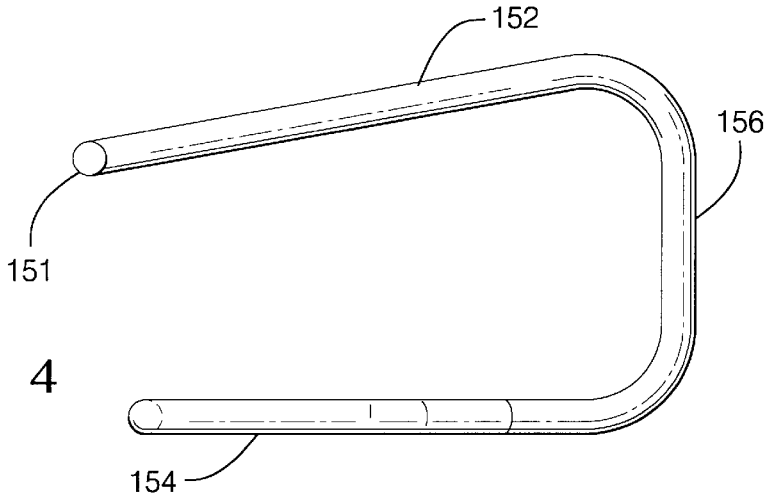
FIG. 4 is a side view of the retainer clip of FIG. 2.
Figure 5:
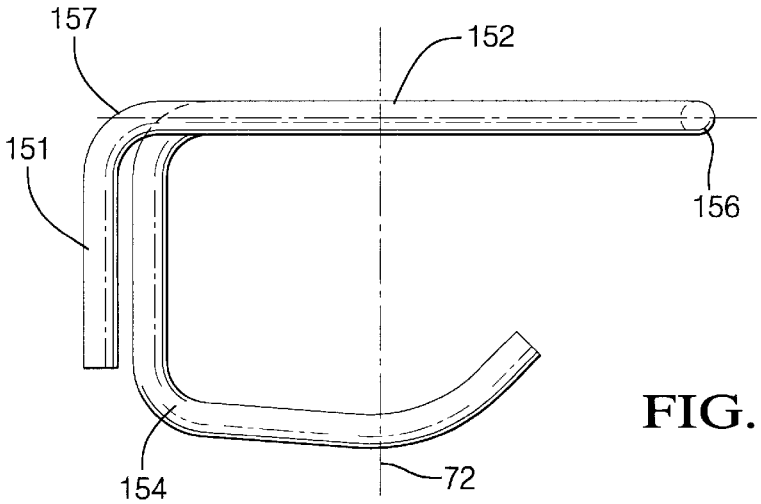
FIG. 5 is a bottom view of FIG. 2

Adjacent the outer end 26, the bottom wall 24 has an upper side 32 and a lower side 34. The lower side 34 includes a socket 36 formed as a recess near the outer end 26 and adapted to receive a part spherical member therein. The upper side 32 is correspondingly deformed upward, forming a generally rounded raised portion 38 axially aligned with the socket 36 below. In use, the finger follower is rockable or pivotable about the center A of the socket 36 in a rocking plane 40 (FIG. 3) passing through the centers of the socket 36 and the valve engaging seat or pallet 30.

The HLA 14 includes a cylindrical body 42 from which projects the lash adjusting cylindrical plunger 16 having a part spherical end 44 including a central oil hole 46. The body 42 includes an annular groove 48 through which oil is received into the HLA for actuating the lash adjusting function and supplying oil through the hole 46 of the plunger.

The retainer clip 18 of the prior art (FIG. 1) is formed as an integral member from a single piece of spring wire. Clip 18 is formed as a U-shaped body 50 having first and second near parallel legs 52, 54 respectively. The legs are interconnected at first ends by a resilient connector portion 56. Each of the legs includes an identical recess, guide recess 58 in the first leg 52 and gripping recess 60 in the second leg 54. Both recesses are formed by bending second ends of the legs, distal from the connector portion 56, with two right angle bends and a smaller angle bend near each end of the wire. The recesses are thus defined by a first edge 62 formed by the extended wire of the respective leg, a connecting end 64 extending laterally relative to the first edge 62, a second edge 66 extending from the connecting end nearly parallel with the first edge 62, but preferably sloping slightly away from the first edge 62 in the direction away from the connecting end 64. An angular end 68 partially closes an inner side of each recess. Each recess 58, 60 is thus configured with a nearly or generally rectangular opening having a partially open end and nearly parallel opposed resilient edges 62, 66, being spaced slightly farther apart adjacent the angular end 68, and are resiliently yieldable by reason of their construction from spring wire.

In assembly with the finger follower 12 and HLA 14, the retainer clip 18 is forced over the outer end 26 of the bottom wall 24 of the finger follower 12 with the legs 52, 54 resiliently engaging the upper and lower sides 32, 34, respectively, of the bottom wall 24. The guide recess 58 of the upper first leg 52 engages and partially surrounds the raised portion 38 to guide the retainer clip into position with the gripping recess 60 below and aligned with the socket 36. The finger follower may then be subassembled to the HLA by pushing the HLA plunger 16 through recess 60 and into follower socket 36 where it is retained by the friction of the resilient first and second edges 62, 66 of the gripping recess opening 60. As part of subassembly 10, once HLA 14 is inserted in the engine, and pallet 30 of follower 12 is positioned in place on valve stem 31, the camshaft can be installed in contact with follower roller 28.

The nearly parallel edges 62,66 of guide recess 58 and of gripping recess 60 only contact the cylindrical diameter of raised portion 38 and plunger 16 at two nearly opposite points 72 which are aligned with the axial centerline of the HLA 14 and normal to the rocking plane 40 of the finger follower 12. Thus, since the retention force B exerted by the prior art clip 18 in retaining follower 12 to HLA 14 is coaxial with the axial centerline A of the HLA, pallet 30 of follower 12 is free to become misaligned from and out of position with valve stem 31 from vibrations and other outside disturbances that may occur during engine assembly and before the camshaft is secured in fixed contact with the follower roller 28.

Referring now to FIGS. 2–8 of the drawings, clip 118 and valve actuator subassembly 110 of the preferred embodiment is shown. Retainer clip 118 is formed as a unitary and monolithic member from a single piece of resiliently-deformable material, such as, for example, spring wire. The material is sized to provide adequate force to retain clip 18 on the bottom wall 24 until HLA 14 is inserted and then to frictionally retain the plunger 16 in place in socket 36 by the resilient edges of the gripping recess 160. Clip 118 is formed as a U-shaped body 150 having resilient segment 156 and having first and second legs 152, 154, respectively, said legs slopping toward each other in the direction away from segment 156. Second leg 154 includes gripping recess 160 for gripping HLA plunger 16. It should be particularly noted that guide recess 158 of clip 118 differs significantly from the shape of gripping recess 160 and guide recess 58 of the prior art in that guide recess 158 is formed by bending second end 151 of first leg 152 distal from radiused segment 156 with one substantially right angle bend 157. The length of segment 156 and length of first leg 152 between segment 156 and right angle bend 157 are selected so that substantially only clip edge 159 is in contact with raised portion 38 of bottom wall 24 of follower 12 or with a portion of upper side 32 of wall 26 between raised portion 38 and roller 28. Thus, retention force B' exerted by first leg 152 of clip 118 in retaining follower 12 to HLA 14 is not coaxial centerline A of the HLA as shown in FIG. 7*a,* but rather is directed downward against follower 12 a distance inward from the pivot or axial centerline of the HLA as shown in FIG. 7*b*. The moment C produced about the centerline of the HLA by second end 151 of first leg 152 of clip 118 after subassembly 110 is installed in the engine induces a downward force D on associated valve stem 31 by pallet 30 of the follower prior to the installation of the cam shaft. Thus, the follower is kept in proper alignment and position with said valve stem until the camshaft is secured in fixed contact with follower roller 28.

Figure 6:
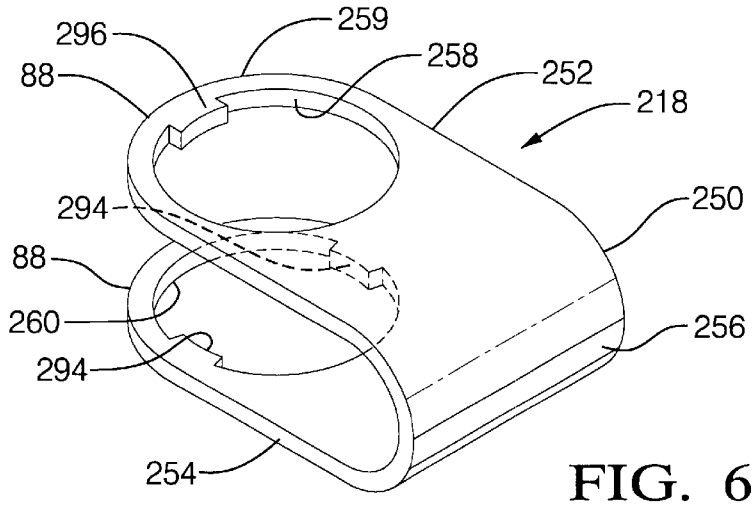
FIG. 6 is a pictorial view of an alternative embodiment of retainer clip according to the invention.

FIG. 6 shows an exemplary alternate embodiment of a retainer clip 218 formed of, for example, bent sheet metal or plastic which could be substituted for the preferred wire clip 118 as described above. Retainer clip 218 is shown having a U-shaped body 250 with generally parallel legs 252, 254 extending from a connecting portion 256 to distal ends 259. Adjacent the distal ends are a guide recess 258 in first leg 252 and a gripping recess 260 in second leg 254, both consisting of essentially round closed-sided openings adjacent distal ends 259 of legs 252, 254. Gripping recess 260 includes inward projections 294 at points lying on or near an axis intersecting the axial centerline of HLA 14. Projections 294 must be resilient and form the resilient edges required to frictionally grip the opposite points on plunger 16 so as to hold the HLA in place.

Figure 7A:
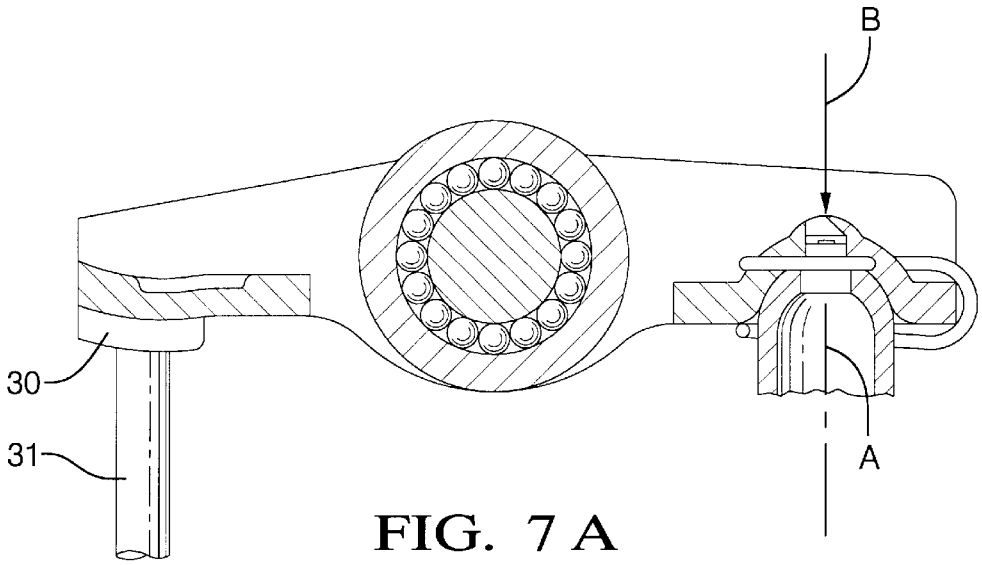
FIG. 7*a* is a side view of the prior art subassembly showing the lines of force of the assembled prior art clip.
Figure 7B:
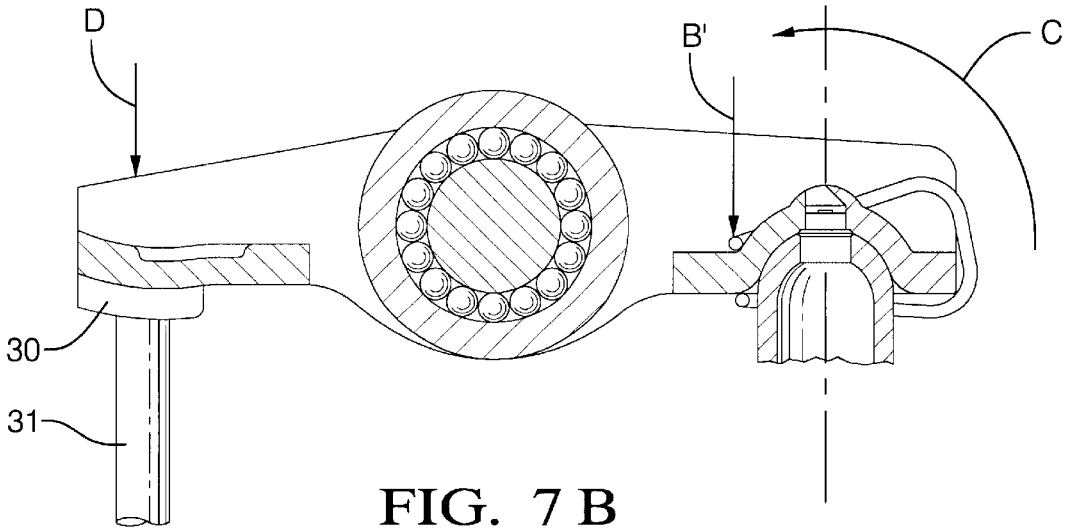
FIG. 7*b* is a side view of a subassembly showing the lines of force of the retainer clip of FIG. 2, and the downward force exerted thereby on the valve stem.

Guide recess 258 includes at least one inward projection 296 positioned adjacent distal end 259 at a point lying opposite connecting portion 256 and positioned so that only at least one projection 296 is in contact with raised portion 38 of bottom wall 24 of follower 12 when clip 218 and HLA 14 are attached to said rocker. Thus, retention force B' exerted by first leg 252 of clip 218 in retaining follower 12 to HLA 14 is not coaxial with the axial centerline A of the HLA as shown in FIG. 7*a,* but rather is directed downward against follower 12 a distance inward from the axial centerline of the HLA as shown in FIG. 7*b*. The moment C produced about the centerline of the HLA by first leg 252 of clip 218 after the subassembly is installed in the engine induces a downward force D on associated valve stem 31 by pallet 30 of the follower prior to the installation of the cam shaft. Thus, the follower is kept in proper alignment and position with said valve stem until the camshaft is secured in fixed contact with follower roller 28.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed:

1. A retainer clip for holding together members of a valve actuator assembly, said clip comprising:

a U-shaped body having first and second legs interconnected at first ends by a resilient segment, said first and second legs adapted to resiliently engage opposite sides of a wall of a rockable actuator member;

said first leg including a guide recess having a clip edge adjacent a second end of said first leg in guiding engagement with a first side of said wall;

said second leg including a gripping recess adjacent a second end of said second leg, and having opposing resilient edges adapted to frictionally grip nearly opposite sides of a cylindrical member upon engagement of the cylindrical member with a socket in a second side of said wall and said resilient edges frictionally gripping said cylindrical member at points nearly aligned on an axis intersecting with and normal to the axial center line of the cylindrical member whereby said retainer clip is adapted to frictionally retain said cylindrical member in said socket of the rockable actuator member in a subassembly positioned for installation in a valve train; and whereby substantially only said clip edge of said guide recess contacts said first side of said wall at a point inward from said axial center line of the cylindrical member thereby imposing a downward force on a valve stem after said subassembly is installed in said valve train.

2. A retainer clip as in claim 1, wherein said guide recess comprises a closed-sided opening.

3. A retainer clip as in claim 2, wherein said guide recess includes at least one inward projection for contacting said first side of said wall.

4. A retainer clip as in claim 1, wherein said U-shaped body is formed as an integral and monolithic member.

5. A retainer clip as in claim 4, wherein said integral member is formed of spring wire.

6. A retainer clip as in claim 4, wherein said integral member is formed of a resilient sheet material.

7. A valve actuator subassembly, comprising:

said retainer clip as in claim 1;

said rockable actuator member; and said cylindrical member;

said actuator including said wall having an end and first and second sides extending from said end, said second side including said socket;

said cylindrical member including a cylindrical diameter and a rounded end received in said socket;

said retainer clip first leg engaging the first side of said wall and said second leg engaging the second side of the wall; the interconnection of said legs extending around said end of the wall;

said clip edge of said guide recess of said first wall contacting said first side of said wall at a point inward from the axial centerline of said cylindrical diameter; and said opposing resilient edges of the gripping recess frictionally gripping nearly opposite sides of said cylindrical diameter at points nearly aligned on an axis intersecting with and normal to the axial center line of said cylindrical diameter to hold said rounded end in engagement with said socket.

8. A valve actuator subassembly as in claim 7, wherein said guide recess is formed as a closed-sided opening.

9. A valve actuator subassembly as in claim 7, wherein said guide recess includes at least one inward projection for contacting said first side of said wall.

10. A valve actuator subassembly as in claim 7, wherein said U-shaped body is formed as an integral member.

11. A valve actuator subassembly as in claim 10, wherein said integral member is formed of spring wire.

12. A valve actuator subassembly as in claim 10, wherein said integral member is formed of a resilient sheet material.

13. A valve actuator subassembly as in claim 7, wherein said rockable member comprises a finger follower and said cylindrical member is a pivot for rocking motion of the finger follower.

14. A valve actuator subassembly as in claim 13, wherein said pivot comprises a plunger of a hydraulic lash adjuster.

15. A retainer clip as in claim 1, wherein said U-shaped body is formed as an integral and monolithic member.

16. A retainer clip as in claim 15, wherein said integral member is formed of spring wire.

17. A retainer clip for holding together members of a valve actuator assembly, said clip comprising:

a U-shaped body having first and second legs interconnected at first ends by a resilient segment, said first and second legs adapted to resiliently engage opposite sides of a wall of a rockable actuator member;

a second end of said first leg formed by a single right angle bend in said first leg;

said first leg including a guide recess adjacent said second end of said first leg, and having a clip edge in guiding engagement with a first side of said wall;

said second leg including a gripping recess adjacent a second end of said second leg, and having opposing resilient edges adapted to frictionally grip nearly opposite sides of a cylindrical member upon engagement of the cylindrical member with a socket in a second side of said wall and said resilient edges frictionally gripping said cylindrical member at points nearly aligned on an axis intersecting with and normal to the axial center line of the cylindrical member whereby said retainer clip is adapted to frictionally retain said cylindrical member in said socket of the rockable actuator member in a subassembly positioned for installation in a valve train; and whereby substantially only said clip edge of said guide recess contacts said first side of said wall at a point inward from said axial center line of the cylindrical member thereby imposing a downward force on a valve stem after said subassembly is installed in said valve train.

18. A valve actuator subassembly, comprising:

said retainer clip as in claim 17;

said rockable actuator member; and said cylindrical member;

said actuator member including a wall having an end and first and second sides extending from said end, and said second side including a socket;

said cylindrical member including a cylindrical diameter and a rounded end received in said socket;

said retainer clip first leg engaging the first side of said wall and said second leg engaging the second side of the wall; the interconnection of said legs extending around said end of the wall;

said clip edge of said guide recess of said first wall contacting said first side of said wall at a point inward from the axial centerline of said cylindrical diameter; and said opposing resilient edges of the gripping recess frictionally gripping nearly opposite sides of said cylindrical diameter at points nearly aligned on an axis intersecting with and normal to the axial center line of said cylindrical diameter to hold said rounded end in engagement with said socket.

19. A valve actuator subassembly as in claim 18, wherein said U shaped body is formed as an integral member.

20. A valve actuator subassembly as in claim 19, wherein said integral member is formed of spring wire.

21. A valve actuator subassembly as in claim 18, wherein said rockable member comprises a finger follower and said cylindrical member is a pivot for rocking motion of the finger follower.

22. A valve actuator subassembly as in claim 21, wherein said pivot comprises a plunger of a hydraulic lash adjuster.

* * * * *